United States Patent [19]

Zijlstra

[11] 4,276,942

[45] Jul. 7, 1981

[54] DEVIATION DEVICE

[75] Inventor: Kornelis N. Zijlstra, Aberdeen, Scotland

[73] Assignee: Shell Oil Company, Houston, Tex.

[21] Appl. No.: 112,262

[22] Filed: Jan. 15, 1980

[30] Foreign Application Priority Data

Jan. 19, 1979 [GB] United Kingdom ..... 01968/79

[51] Int. Cl.[3] ..... E21B 7/08

[52] U.S. Cl. ..... 175/21; 175/73; 175/402

[58] Field of Search ..... 175/9, 19, 61, 21, 73, 175/402, 405

[56] References Cited

U.S. PATENT DOCUMENTS

| | | | |
|---|---|---|---|
| 1,019,357 | 3/1912 | Porter et al. | 175/402 |
| 3,051,254 | 8/1962 | McClinton | 175/73 X |
| 3,415,329 | 12/1968 | Marlind | 175/61 X |
| 3,610,346 | 10/1971 | Ziober | 175/61 X |
| 3,899,032 | 8/1975 | Reese | 175/9 |
| 3,968,847 | 7/1976 | Werblin | 175/402 |
| 4,027,734 | 6/1977 | Horvath | 175/61 X |

*Primary Examiner*—James A. Leppink

[57] ABSTRACT

A deivation device for causing a conductor string to deviate as it is being driven into a subterranean formation.

The deviation device comprises a straight tubular element, open at both ends, wherein the wall of the tubular element at an end part is provided with guide faces normally directed downwardly in the formation. These guide faces are inclined relative to the longitudinal axis of the tubular element and are arranged within the periphery of the tubular element.

Said guide faces consist of a first guide face at the outer side of the tubular element and a second guide face at the inner side of the tubular element. The wall portion of the tubular element which is provided with the first guide face is arranged diametrically opposite to the wall portion of the tubular element which is provided with the second guide face, the guide faces of the tubular element, when taken in diametric cross-section, being substantially parallel to each other and at the same angle to the axis of the tubular element.

8 Claims, 4 Drawing Figures

DEVIATION DEVICE

The invention relates to a deviation device for causing a conductor string to deviate as it is being driven into a subterranean formation.

BACKGROUND OF THE INVENTION

In the drilling industry it is well known to use slightly curved conductor strings for improving and facilitating directional drilling operations. For this purpose it is known to use a deviation device (also called deviation shoe) connected to the lower end of a conductor string for causing the conductor string to bend so that the desired slight curvature of the conductor string is obtained, as it is being driven into a subterranean formation, as shown in U.S. Pat. No. RE. 29,929.

It is an object of the invention to provide a deviation device of simple and compact construction as compared to the known deviation devices.

SUMMARY OF THE INVENTION

The deviation device according to the invention, comprises a straight tubular element, open at both ends, wherein the wall of the tubular element at an end part is provided with guide faces, said guide faces being inclined relative to the longitudinal axis of the tubular element and being arranged within the periphery of the tubular element, wherein said guide faces consist of a first guide face at the outer side of the tubular element and a second guide face at the inner side of the tubular element, wherein the wall portion of tubular element which is provided with the first guide face is arranged diametrically opposite to the wall portion of the tubular element which is provided with the second guide face.

Furthermore the invention relates to a conductor system comprising a conductor string provided at its lower end with the above deviation device, wherein the deviation device has the same outer diameter as the conductor string and wherein the longitudinal axes of the deviation device and of the conductor string coincide when the deviation device and the conductor string are connected together.

The deviation device according to the invention has the advantage that it exists basically of a straight piece of pipe having the same outer diameter as the conductor string for which the deviation device is destined, so that the deviation device is of a simple and compact construction. Moreover, the deviation device is adapted to be secured to the lower end of the conductor string in such a manner that the longitudinal axes of the conductor string and of the deviation device coincide. This has the advantage that the deviation device is flush with the conductor string so that the deviation device together with the conductor string can be easily passed through the well-known annular conductor string guide members, without the need for having to adapt the said guide members to the requirements of the deviation device.

BRIEF DESCRIPTION OF THE DRAWING

The invention will be further explained with reference to the drawings wherein.

DESCRIPTION OF A PREFERRED EMBODIMENT

Figure 1:
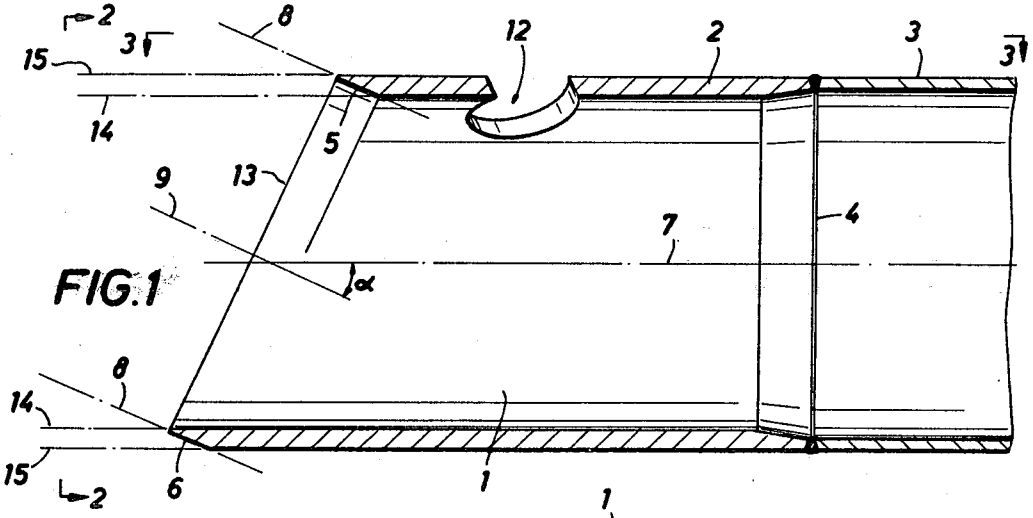
FIG. 1 shows a longitudinal cross-section of a deviation device according to the invention.

In all the Figures the deviation device is generally indicated by the reference numeral 1.

Figure 2:
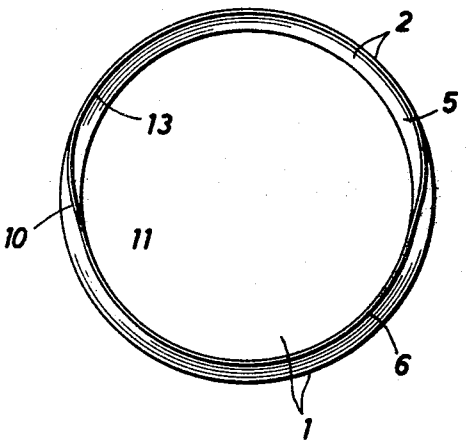
FIG. 2 shows a side view of the same deviation device as seen in FIG. 1.
Figure 3:
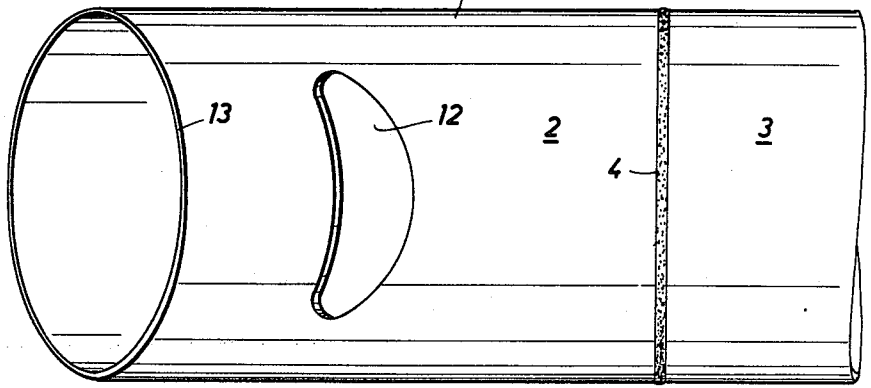
FIG. 3 shows a side view of the same deviation device as seen in FIG. 1.

As shown in FIG. 1, 2, and 3 the deviation device 1 (also called deviation shoe) comprises a straight tubular element 2, which is connected to a conductor string 3, for example, by means of a weld 4. The outer diameter of the tubular element 2 is preferably equal to the outer diameter of the conductor string 3, whereas the wall thickness of the tubular element 2 is, at least partly, enlarged relative to the wall thickness of the conductor string 3. The free end part of the tubular element 2 is provided with guide faces 5 and 6, which are inclined relative to the longitudinal axis 7 of the tubular element 2 and parallel to each other at points diametrically opposite on the tubular element. Each guide face 5 and 6 is arranged between the inner- and the outer periphery 14 respectively 15 of the tubular element 2.

The guide faces 5 and 6 are formed by parts of a cylindrical surface 8, having a longitudinal axis 9 which intersects and makes a desired angle $\alpha$ (of for example 20°) with the longitudinal axis 7 of the tubular element 2. The angle $\alpha$ predetermines the degree of curvature of the conductor string 3 when it is being driven into the formation. The flat free end surface 13 of the tubular element 2 is preferably perpendicular to the axis 9, so that the guide faces 5 and 6 are substantially perpendicular to the free end surface 13 of the tubular element 2.

As shown in FIG. 2 the guide faces 5 and 6 are each substantially semi-cylindrical, whereas smooth transitions 10 and 11 are arranged between the guide faces 5 and 6.

The wall of the tubular element 2 is furthermore provided with suitable rotation-limiting means such as a hole 12 for preventing rotation of the deviation device around its longitudinal axis 7 when it is driven into the formation. For reasons of strength this hole is preferably arctuate in form or of such a shape that it resembles a shark's mouth, as shown in FIG. 3.

Figure 4:
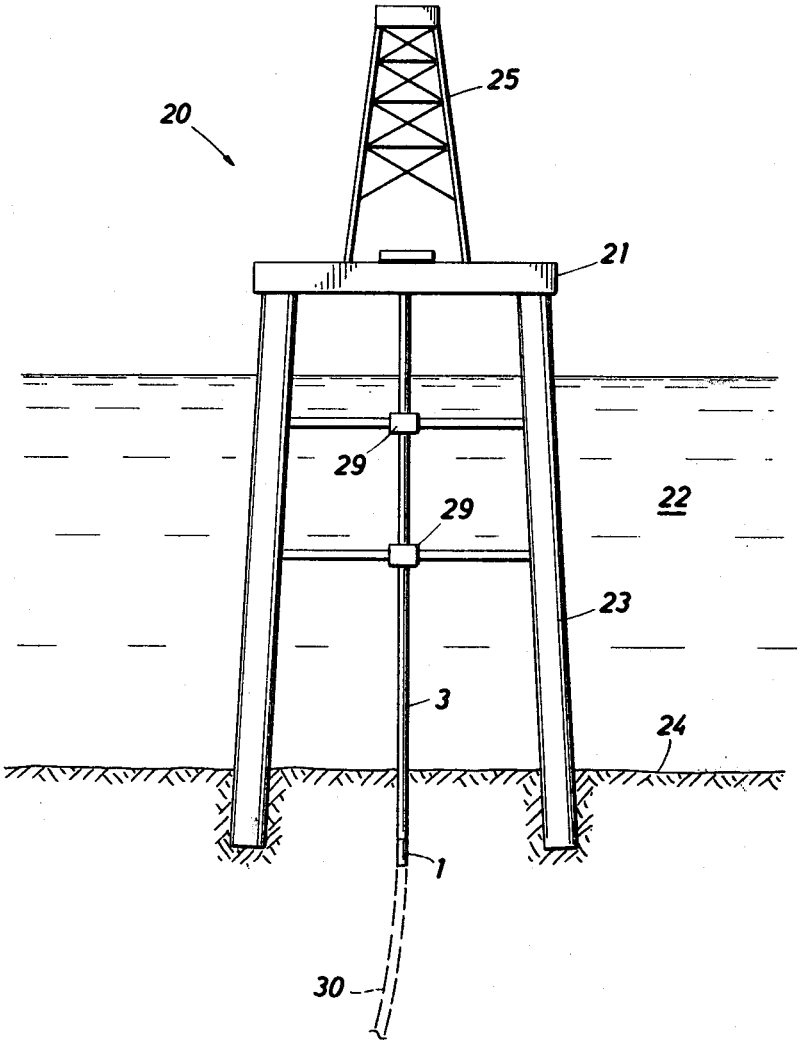
FIG. 4 shows a schematic side view of a marine structure provided with a conductor string and a deviation device according to the invention.

The use of the deviation device 1 will now be explained with reference to FIG. 4. This FIG. 4 shows a marine structure, generally indicated by reference numeral 20, which comprises a platform 21 above a body of water 22 and legs 23, attached to the platform 21, said legs 23 being supported by the bottom 24 of the body of water 22.

The platform 21 is provided with drilling equipment schematically indicated by reference numeral 25. A conductor string 3 extends from the platform 21 into the bottom 24 and is provided at its lower end with a deviation device 1, as shown in detail in the FIGS. 1, 2, and 3. The marine structure 20 is furthermore provided with conventional annular guide members 29, for guiding the conductor string 3, as it is being passed through the body of water 22 and driven into the bottom 24. Because of the fact that the outer diameters of the deviation device 1 and the conductor string 3 are equal and the longitudinal axes of the deviation device 1 and of the conductor string 3 coincide, the passages of the guide members 29 need not to be adapted to any radial extension of the deviation device 1 outside the circumference of the conductor string 3.

When the conductor string 3 is being driven into the bottom 24, the soil pressure on the guide faces 5 and 6, shown in FIGS. 1 and 2, at the lower end of the device 1, will cause the conductor string 3 to bend slightly so that a slight curvature of the conductor string 3 is obtained and the conductor string 3 deviates from the vertical as indicated by the dotted lines 30. The direction of deviation depends on the position of the guide faces relative to the marine structure 20.

The opening 12 as shown in FIGS. 1 and 3 prevents the conductor string from rotating around its longitudinal axis when it is being driven into the bottom 24.

It will be appreciated that it is not necessary to provide substantially the whole wall of the tubular element at the free end part with guide faces. Instead it is possible to provide only part of the wall with guide faces, provided that the wall part with the guide face at the inner side of the tubular element is arranged diametrically opposite to the wall part with the guide face at the outer side of the tubular element.

Furthermore, it will be appreciated that instead of a weld-connection between the conductor string and the deviation device any other suitable connection can be used.

Finally, it will be appreciated that the invention is not restricted to a deviation device for use on a marine platform, but can be used as well on shore.

I claim as my invention:

1. A deviation device for causing a conductor string to deviate as it is being driven into a subterranean formation, comprising a straight tubular element, open at both ends, wherein the wall of the tubular element at an end part is provided with guide faces, said guide faces being inclined relative to the longitudinal axis of the tubular element and being arranged within the periphery of the tubular element, wherein said guide faces consist of a first guide face at the outer side of the tubular element and a second guide face at the inner side of the tubular element, wherein the wall portion of the tubular element which is provided with the first guide face is arranged diametrically opposite to the wall portion of the tubular element which is provided with the second guide face with each of said first guide face and said second guide face extending substantially one-half way around the tubular element and joint each other in smooth transition.

2. The deviation device as claimed in claim 1, wherein the end surface of said end part has the shape of a flat plane and each guide face is substantially perpendicular to the flat plane.

3. The deviation device as claimed in claim 1, wherein each guide face has the shape of a part of a cylindrical surface.

4. The deviation device as claimed in claim 3, wherein both guide faces are formed by parts of one cylindrical surface, having a longitudinal axis which intersects and is inclined relative to the longitudinal axis of the tubular element.

5. The deviation device as claimed in claim 1, wherein the wall of the tubular element is provided with rotation-limiting means for preventing rotation of the conductor string when it is being driven into the subterranean formation.

6. The deviation device as claimed in claim 1, wherein the guide faces are arranged between the inner- and the outer periphery of the tubular element.

7. A deviation device as claimed in claim 5, wherein the rotation-limiting means is a hole through the wall of said tubular element above one of the guide faces thereof.

8. A conductor system comprising a conductor string provided at its lower end with a deviation device for causing a conductor string to deviate as it is being driven into a subterranean formation, comprising a straight tubular element, open at both ends, wherein the wall of the tubular element at an end part is provided with guide faces, said guide faces being inclined relative to the longitudinal axis of the tubular element and being arranged within the periphery of the tubular element, wherein said guide faces consist of a first guide face at the outer side of the tubular element with each of said first guide face and said second guide face extending substantially one-half way around the tubular element and joint each other in smooth transition.

* * * * *